US005119792A

United States Patent [19]

Gu

[11] Patent Number: 5,119,792

[45] Date of Patent: Jun. 9, 1992

[54] ELECTROMAGNETIC FUEL INJECTOR WITH CENTRAL AIR BLOW AND POPPET VALVE

[75] Inventor: Huan-Lung Gu, Hsinchu, Taiwan

[73] Assignee: Industrial Technology Research Institute, Taiwan

[21] Appl. No.: 638,723

[22] Filed: Jan. 7, 1991

[51] Int. Cl.[5] ..... F02M 23/00

[52] U.S. Cl. ..... 123/533

[58] Field of Search ..... 123/533, 531, 73 C, 123/472; 239/5, 585

[56] References Cited

U.S. PATENT DOCUMENTS

| | | | |
|---|---|---|---|
| 4,754,739 | 7/1988 | Czwienczek et al. | 123/531 |
| 4,794,901 | 1/1989 | Hong et al. | 123/533 |
| 4,899,714 | 2/1990 | Schechter et al. | 123/533 |
| 4,986,247 | 1/1991 | Kushiba et al. | 123/533 |
| 4,993,394 | 2/1991 | McKay et al. | 123/533 |

*Primary Examiner*—Raymond A. Nelli

*Attorney, Agent, or Firm*—Lowe, Price, LeBlanc & Becker

[57] ABSTRACT

A fuel injection mechanism for a two-stroke engine has two valve assemblies controlled by two solenoid assemblies. One solenoid assembly is provided for controlling the quantity of fuel to be injected into the fuel chamber, and the other solenoid assembly includes a main solenoid for controlling the opening of a main fuel injection valve at an appropriate time, whereby fuel pre-stored in the fuel chamber is atomized and injected by a flow of high-pressure air. The main fuel injection valve is formed in a mushroom shape, wherein its middle portion is hollow and provides a passage for compressed air. The flow of compressed air, in two streams, is used for the cylinder head injection to improve an injection spray effect, to shorten the time of cleaning the fuel injector and to simplify the structure.

1 Claim, 5 Drawing Sheets

ELECTROMAGNETIC FUEL INJECTOR WITH CENTRAL AIR BLOW AND POPPET VALVE

FIELD OF THE INVENTION

This invention relates to an electromagnetic fuel injector for a two-stroke engine, particularly to an electromagnetic fuel injector with compressed air and fuel injection through a cylinder head of a two-stroke engine with improved spray injection effect and shortened time of fuel injection.

BACKGROUND OF THE PRIOR ART

Fuel injectors for two-stroke engine, and particularly one that can be used for a cylinder head fuel injection system allow a two-stroke engine to be so improved as to rival the four-stroke engine. As a result, the injection system and the structure of an injector for two-stroke engines have been major subjects for a number of engine research institutes. Leading auto-makers such as Japan's TOYOTA, SUBARU, MAZDA, and NIPPON DENSO, General Motors (GM) and FORD in the U.S., and ORBITAL Engine Co. of Australia have been engaged in relevant research. The most significant jet-type fuel injector is shown in FIG. 1 and is one developed by the Australian ORBITAL Engine Co. The main body of this injector has a fuel passage 100 and the main valve has an air passage 200. When the main valve is opened, a predetermined amount of fuel from the fuel passage can be atomized and injected by means of high-pressure air.

However, such a jet-type fuel injector for a two-stroke engine has the following problems:

(1) the atomizing effect is limited, because only the air from the main valve will enter into the oil passage of the main body of injector to push out the fuel therein; and (2) because not only is the pressure provided from a stream of air insufficient but, also, fuel in the fuel passage is not pre-mixed with air.

SUMMARY OF THE INVENTION

In view of the above problems with the jet-type fuel injector for the two-stroke engine, an object of the present invention is to provide an improved jet-type injector for a two-cycle engine. According to the present invention, there are two injector assemblies, with an air passage for leading in a flow of air to push out fuel that has stayed within the main fuel injector temporarily.

The other object of this invention is to lead a stream of air into the oil passage of a mail fuel injector for pre-mixing with fuel, which air stream stays therein temporarily to improve an atomizing effect.

The present invention will become more readily apparent from the following description of the preferred embodiment taken in conjunction with drawings.

DETAILED DESCRIPTION OF PREFERRED EMBODIMENT

Figure 1:
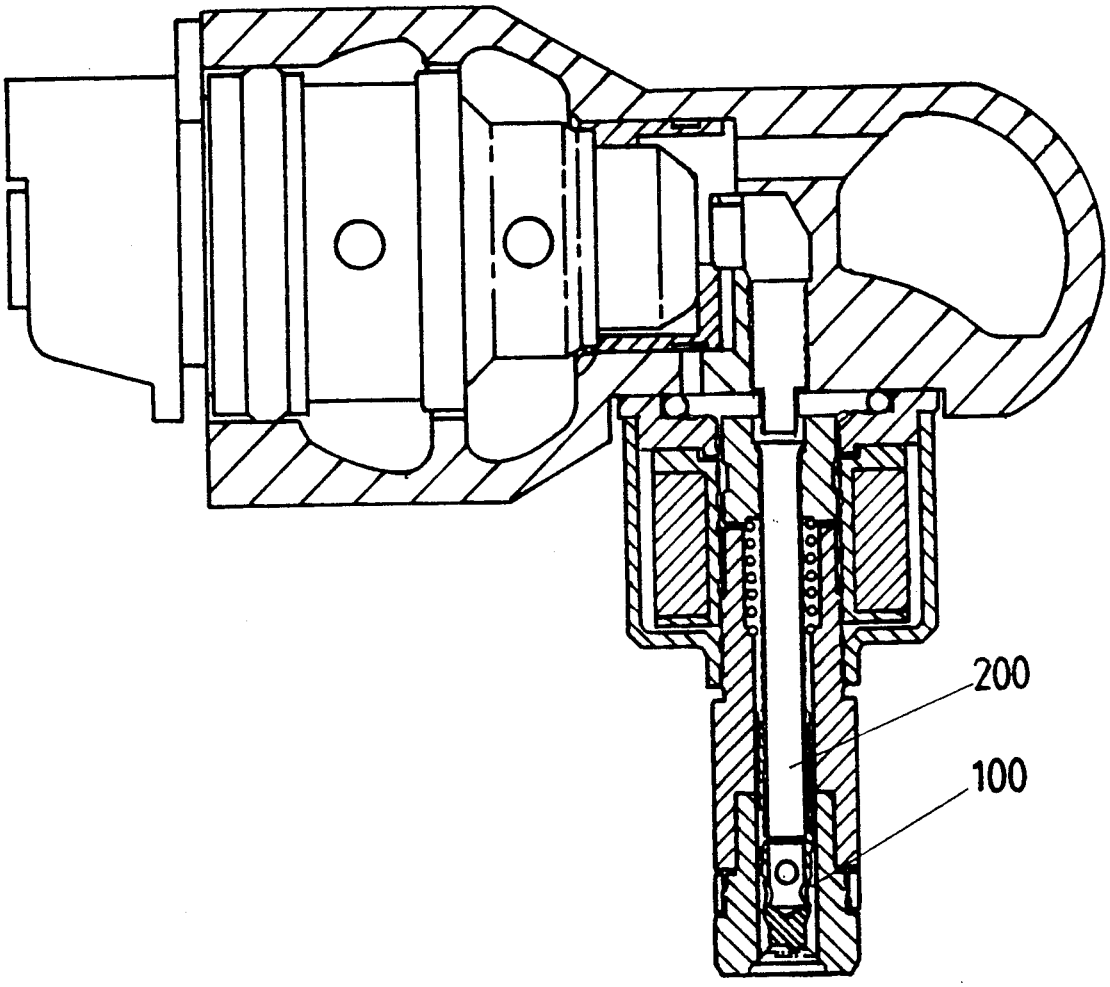
FIG. 1 (PRIOR ART)
FIG. 1 is a partial sectional view showing a known jet-type injector for a two-stroke engine.
Figure 2:
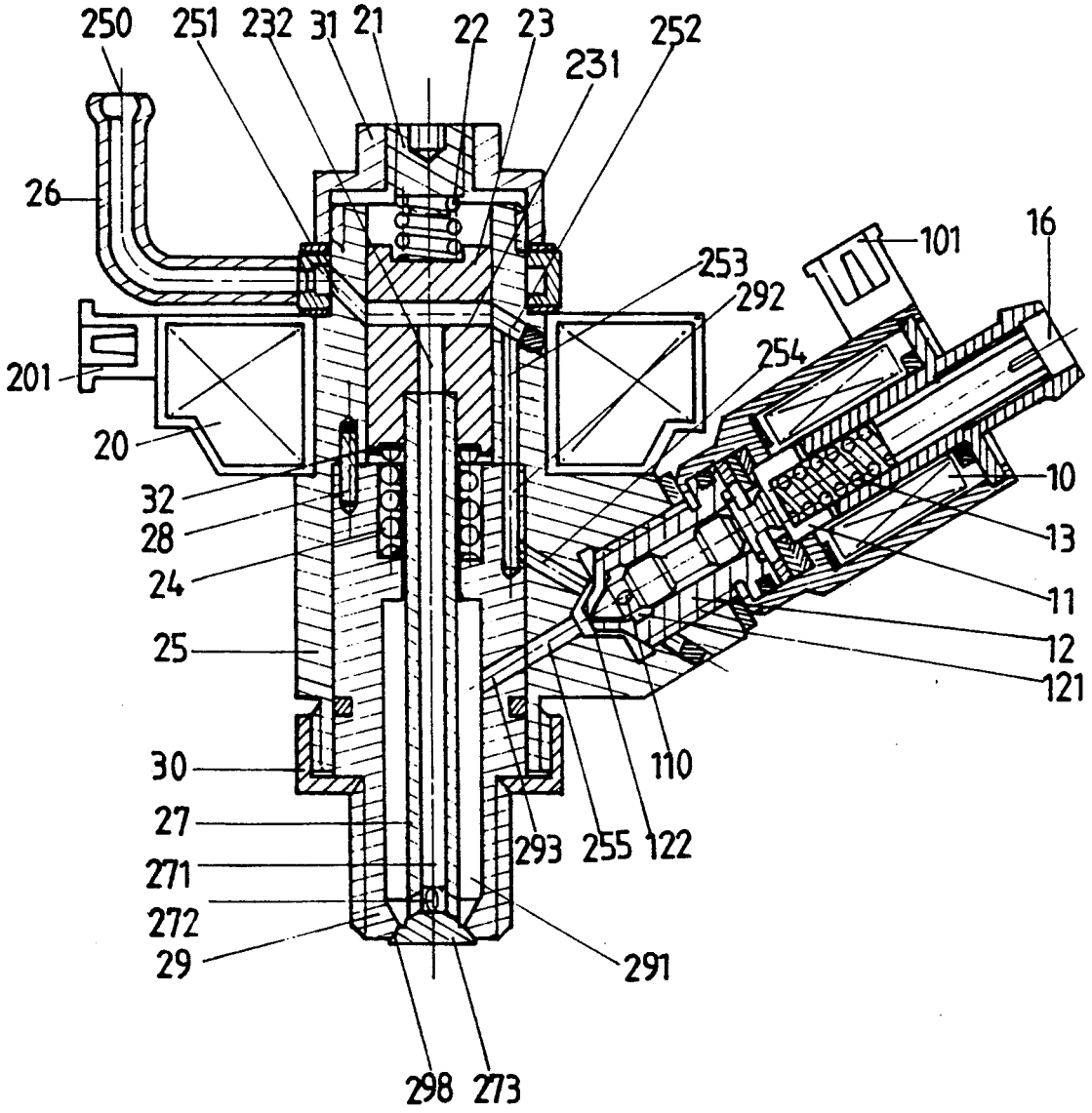
FIG. 2 is a longitudinal-sectional view of a preferred embodiment of this invention.

As best seen in FIG. 2, a jet-type injector for a two-stroke engine according to a preferred embodiment of the present invention comprises two injector assemblies 1 and 2 and two solenoid assemblies 10 and 20 for controlling a fuel needle valve assembly 11 and main injection valve assembly 27 respectively, wherein solenoid 10 is provided only to control the amount of fuel supplied per injection. Solenoid 10 assembly generates less electromagnetic force than solenoid assembly 20 and is a conventional injector. Solenoid assembly 20 is the main solenoid assembly and generates the stronger electromagnetic force and is provided to control a high-pressure air switch and main injection valve 27 for atomizing a mixture of air with fuel during injection into the engine.

Referring to FIG. 2 again, injector assembly 1 has a signal connector 101 for transmitting a control signal for fuel injection to the solenoid 10, whereby the solenoid 10 generates an electromagnetic force to raise the needle valve assembly 11 so that a quantity of fuel at a relatively low pressure will enter through the inlet 16 and flow out of orifice 110 to fill a space 121 surrounding the needle valve 11.

Behind the needle valve assembly 11, there is a bias spring 13. While no current flows in the solenoid assembly 10, the needle valve assembly 11 will be held against an outlet 122 so tightly as to stop the fuel within the space 121 from flowing out of it. Fuel passage 255 from said outlet 122 communicates with another fuel passage 293 which is formed through the external wall of main injector assembly 2 and into a fuel chamber 291. When needle valve assembly 11 is raised by an electromagnetic force generated by the solenoid assembly 10, fuel will be injected through the outlet 122 and oil passages 255 and 293, into the fuel chamber 291 of main injector 2. The volume of fuel supplied by such a nozzle arrangement is determined by how long and how many times needle valve assembly 11 is operated and the fuel pressure. The fuel pressure preferably is kept stable at 94.5 psi. When the injection control signal disappears, the needle valve assembly 11 descends back to its original rest position and seals the outlet 122 tightly.

Figure 3:
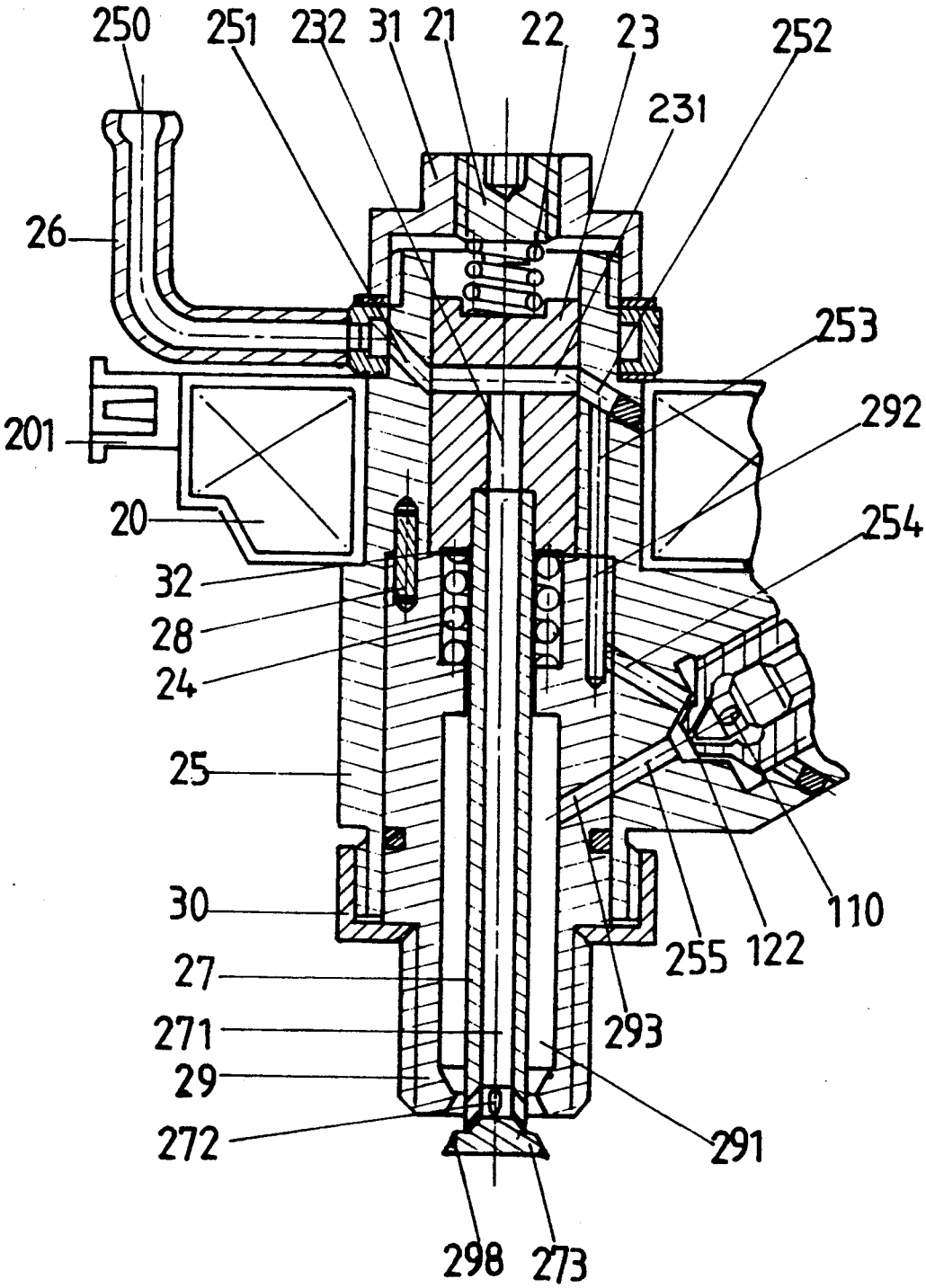
FIG. 3 is a longitudinal-sectional view of the main injector of this invention.

Referring now to FIGS. 2 and 3, after a charge or quantity of fuel is injected into the fuel chamber 291 of main injector 2, this fuel will not be injected immediately into the cylinder of engine but will stay inside the fuel chamber 291 temporarily. Outside the main nozzle 2 there is a corresponding signal connector 201. When injection timing is reached, a control signal for injection is transmitted through signal connector 201 to the solenoid assembly 20 to enable it to generate a very strong electromagnetic force to pushing the valve seat 23 downward. Valve seat 23 is mounted within the main injector 2 to control fuel injection. At a delivery end portion of fuel injector 2 is a valve stem 27 with an end shaped as a mushroom with a bevel edge. When valve seat 23 is not pushed downward, high-pressure air is transmitted through air duct 26 into air passage 251 and fills air passages 231, 232, 271, 253, 254 and 293, and fuel chamber 291. This air pressure preferably is kept stable at 80 psi.

At this time, valve face 273 adjacent the leading end of mushroom valve 27 also contacts the bevel 298 of injection head 29 to stop fuel momentarily stored in fuel chamber 291 from flowing out of it. Because the pressure of fuel is greater than that of the compressed air, and the relationship between fuel pressure and air pressure is stable, a quantity of the fuel is injected into the fuel chamber 291. This fuel quantity will be determined quite accurately and can not be affected by environmental factors such as the pressures of individual cylinders of the engine.

Figure 4:
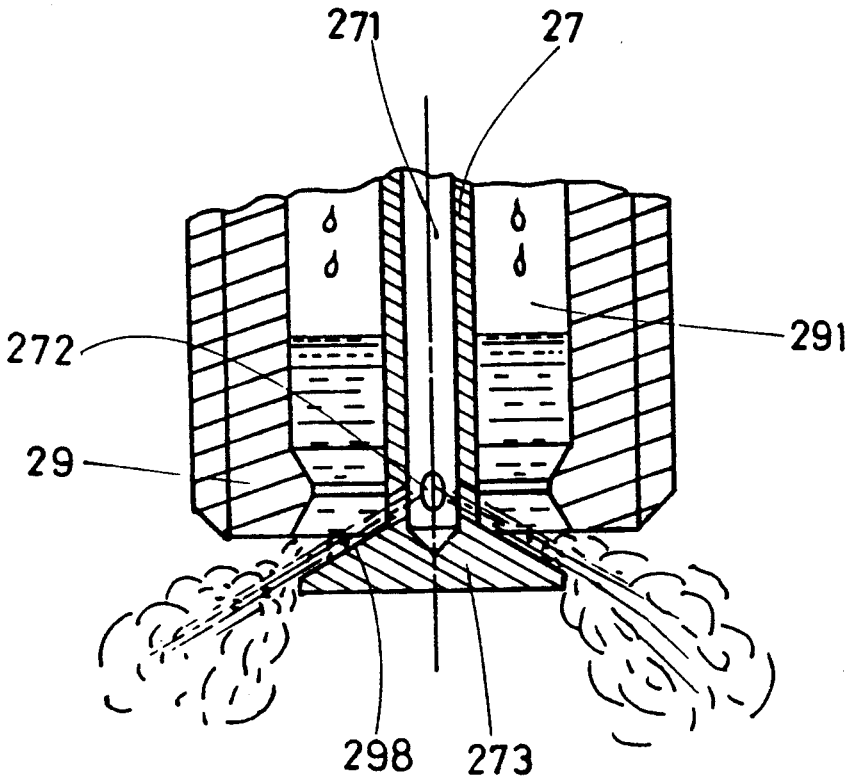
FIG. 4 is a longitudinal-sectional view showing an air/fuel flow as the main valve is being opened.

Still referring to FIG. 2 thru FIG. 4, when valve seat 23 of the mushroom valve 27 has moved downward by a certain distance, the delivery valve port of injection had 29 is opened, whereby fuel from within the fuel chamber 291 flows out. Simultaneously, high-pressure air acts to inject the fuel radially. As there is an air inlet 251 at the top side of main body of main nozzle 2, after entering into said inlet 251, the air flow is divided into two streams. One air stream comprising a small amount of air enters into the fuel chamber 291 through passages 252, 253, 254, 255 and 293, not only pushing out fuel oil into fuel chamber 291 but also clearing away residual fuel oil near the oil outlet 122 of passage 255. Mushroom valve 27 resembles a hollow mushroom shape and has an air passage 271 therein, of which an inlet port at the top end connects with air passage 232, an a bottom and which forms an air injection port 272 throughout the valve. Thus a stream of compressed air enters through air inlet 250, passes via the passages 232 and 271, and is injected with fuel through the injection port 272. Once this fuel flows out, it will be atomized and injected in a very short time due to being squeezed by the compressed air and as it encounters air in the engine cylinder.

When the injection stops, the corresponding control signal and electromagnetic force disappear too. The valve seat 23 and mushroom valve 27 will move up and return out their respective original positions due to the restoring force of a compression spring 24. See FIG. 3. An E-type retainer clip 32 is provided between compression spring 24 and mushroom valve 27 to position the compression spring 24. There is another compression spring 22, mounted on top of valve seat 23, provided to counter the inertial force produced due to valve seat returning to its original position so as to buffer instantaneous impact. The elastic force of compression spring 22 can be adjusted through adjusting screw 21.

The end of high-pressure air pipe 26 forms a ring shape and is fixed by a nut 30 on top of the body of main injector 25. Injection head 29 is fixed by a locked nut 30 at the bottom of body of injector 25, and is orientated by a positioning pin 28 to maintain communication between air passage 253 and passage 292, and between air passage 255 and passage 293.

Figure 5:
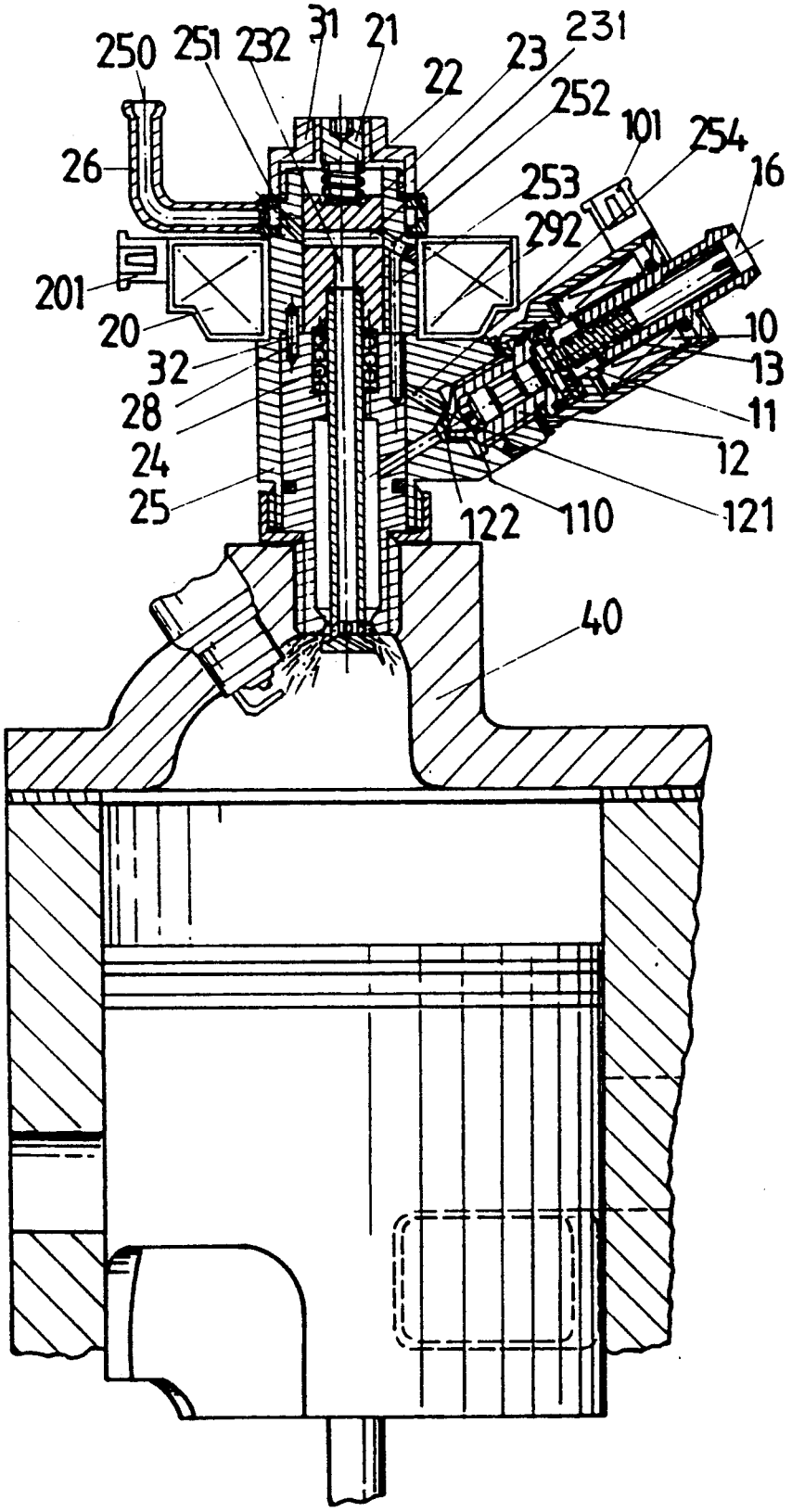
FIG. 5 is a longitudinal-sectional view illustrating a fuel injector according to this invention fitted to an upper portion of an engine.

Referring to FIG. 5, the jet-type injector according to this invention can be mounted at the head of a cylinder 40 of an engine for direct fuel injection, and the function produced by the disclosed structure is better than with any known device.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A fuel injection mechanism employing compressed air, suitable for use with a two-stroke engine, comprising:

a first solenoid assembly provided to control a needle valve for determining an amount of fuel injected by a first injector, and a second solenoid assembly provided to control a mushroom valve for to provide an air and fuel mixture via a main injector to an engine cylinder; and a fuel chamber formed in said main injector surrounding the mushroom valve and communicating with an outlet of the main injector, wherein the mushroom valve is hollow and has a longitudinal air passage therethrough, communicating via the main chamber through an air inlet formed on a side of the main injector, wherein an air injection hole communicating with the air passage inside the mushroom valve is formed at an upper edge of an umbrella-like bevel face of mushroom valve, and said air inlet in the main injector communicates with a by-pass passage leading to the front end of the needle valve of the first injector.

* * * * *